US006206473B1

(12) United States Patent
Kondratiev

(10) Patent No.: US 6,206,473 B1
(45) Date of Patent: Mar. 27, 2001

(54) APPARATUS AND METHOD FOR CONSTRUCTING KNOCKDOWN FURNITURE FROM PAPERBOARD MATERIAL AND THE LIKE

(76) Inventor: Igor Kondratiev, 148 Pineview Dr. #6, Carmel, IN (US) 46032

( * ) Notice: Subject to any disclaimer, the term of this patent is extended or adjusted under 35 U.S.C. 154(b) by 0 days.

(21) Appl. No.: 09/198,870

(22) Filed: Nov. 24, 1998

(51) Int. Cl.[7] ..... A47C 7/00
(52) U.S. Cl. ..... 297/440.1; 297/440.12
(58) Field of Search ..... 297/440.1, 440.12, 297/440.13, 440.14, 16.1, 16.2

(56) References Cited

U.S. PATENT DOCUMENTS

| | | | | |
|---|---|---|---|---|
| 1,662,121 | | 3/1928 | Moncrieff . | |
| 1,776,071 | * | 9/1930 | Horwath | 108/157.14 X |
| 1,854,663 | * | 4/1932 | Nebel | 297/440.12 X |
| 1,903,631 | * | 4/1933 | Morrison | 108/157.14 X |
| 2,279,864 | | 4/1942 | Eide | 297/440.13 X |
| 2,361,875 | | 10/1944 | Sachs | 108/165 |
| 2,806,514 | * | 9/1957 | Smith | 297/440.12 |
| 2,940,513 | * | 6/1960 | Holden | 297/440.12 |
| 2,955,647 | * | 10/1960 | Smith | 297/440.12 |
| 3,121,588 | * | 2/1964 | Beckman et al. | 297/440.12 X |
| 3,126,140 | * | 3/1964 | Lizan et al. | 297/440.12 X |
| 3,220,362 | * | 11/1965 | Downes | 108/165 |
| 3,262,405 | | 7/1966 | Sutton . | |
| 3,566,808 | | 3/1971 | Slate et al. | 297/440.12 X |
| 3,620,175 | | 11/1971 | Crane et al. | 108/157.14 |
| 3,714,908 | | 2/1973 | Notko | 108/152.14 |
| 3,724,399 | | 4/1973 | Notko et al. | 108/157.14 |
| 3,729,244 | * | 4/1973 | Butler | 297/440.12 X |
| 3,837,719 | * | 9/1974 | Barron | 297/440.12 X |
| 3,866,550 | | 2/1975 | Geschwender | 297/440.12 X |
| 3,871,726 | * | 3/1975 | Stegner | 297/440.12 X |
| 4,078,502 | | 3/1978 | Barna . | |
| 4,084,517 | | 4/1978 | Guess . | |
| 4,085,970 | * | 4/1978 | Klein | 297/440.12 |
| 4,138,951 | | 2/1979 | Nelson . | |
| 4,267,998 | | 5/1981 | Weirich . | |
| 4,340,251 | * | 7/1982 | Geoffroy-Dechaume | 297/440.12 |
| 4,348,052 | | 9/1982 | Roland | 297/440 |
| 4,546,941 | * | 10/1985 | Hildebrand | 297/440.12 X |
| 4,632,040 | | 12/1986 | Sheffer . | |
| 4,632,345 | | 12/1986 | Barley . | |
| 4,841,882 | | 6/1989 | Ehrman | 297/492.12 X |
| 4,875,737 | * | 10/1989 | Cardenas | 297/440.12 |
| 4,926,759 | | 5/1990 | Vitsky et al. . | |
| 4,984,848 | * | 1/1991 | Scalisi et al. | 297/440.12 |
| 5,018,454 | | 5/1991 | Negus | 108/157.14 |
| 5,069,144 | | 12/1991 | Williford . | |
| 5,263,766 | | 11/1993 | McCullough | 297/440.12 |
| 5,382,081 | * | 1/1995 | Henry | 297/440.12 |
| 5,394,810 | * | 3/1995 | Howard et al. | 297/165 |
| 5,580,131 | | 12/1996 | Ribot | 297/440.12 |
| 5,682,623 | | 11/1997 | Fenoglio | 297/440.12 X |
| 5,697,675 | * | 12/1997 | DeWitt et al. | 297/440.12 |

* cited by examiner

*Primary Examiner*—Peter M. Cuomo
*Assistant Examiner*—Rodney B. White
(74) *Attorney, Agent, or Firm*—Woodard, Emhardt, Naughton, Moriarty & McNett

(57) ABSTRACT

An article of collapsible furniture includes a top member and a base having multiple panels, each of the panels being hingedly connected to at least one other of the panels, and wherein the base has a collapsed storage condition wherein the panels are folded atop one another, and the base has an expanded load supporting condition wherein the panels are unfolded to form, in horizontal cross-section, a central load-supporting polygon, the polygon being a concave octagon. A connection assembly includes a series of slotted tabs that engage with a corresponding series of hooked slots to releasably lock the top member in a load supporting position atop the base.

23 Claims, 14 Drawing Sheets

APPARATUS AND METHOD FOR CONSTRUCTING KNOCKDOWN FURNITURE FROM PAPERBOARD MATERIAL AND THE LIKE

FIELD OF THE INVENTION

The present invention relates generally to furniture, and more particularly to the construction of knockdown furniture from lightweight and foldable panel material such as fiberboard or cardboard and the like.

BACKGROUND OF THE INVENTION

There is a fairly diverse market for lightweight, portable furniture such as tables and chairs that can be easily transported and assembled or erected on site and that can be disassembled or "knocked down" for easy disposal or stored for another day. Such furniture finds particular application for picnics, parties and college student living quarters. Such furniture should be easy to assemble or erect and knock back down to a storage condition. It should also be inexpensive to ship in bulk and easy to display in a variety of different stores, such as hardware stores, drug stores, department stores, variety stores, and bookstores. Furniture that is shipped and sold in a generally flat, unassembled condition and is made of cardboard or fiberboard or the like is ideal for such purposes.

Over the years, a number of furniture constructions have been developed whereby the furniture piece is erected or constructed from one or more components made of cardboard or a similar material and from a generally flat, and unassembled or folded condition. Examples of these and similar furniture constructions may be found in the following U.S. Patents:

| Patent No. | Inventor |
|---|---|
| 1,662,121 | Moncrieff |
| 2,279,865 | Eide |
| 2,361,875 | Sachs |
| 3,262,405 | Sutton |
| 3,566,808 | Slate Jr. |
| 3,620,175 | Crane et al. |
| 3,714,908 | Notko |
| 3,724,399 | Notko et al. |
| 3,866,550 | Geschwender |
| 4,078,502 | Barna |
| 4,084,517 | Guess |
| 4,138,951 | Nelson |
| 4,348,052 | Roland |
| 4,632,040 | Sheffer |
| 4,632,345 | Barley |
| 4,841,882 | Ehrman |
| 4,926,759 | Vitsky et al. |
| 5,018,454 | Negus |
| 5,069,144 | Williford |
| 5,263,766 | McCullough |
| 5,580,131 | Ribot |
| 5,682,623 | Fenoglio |
| JP406237832 A | Maruni Kagu Kogyo K.K. |
| GB2151473 A | Jedzinski |
| FR002505636 A3 | Roch |

The articles of furniture disclosed in the above-referenced patents are assembled from either a single cut blank with fold lines and assembly tabs and slots, or from two or more pre-cut and/or pre-assembled sections that are interfitted together using a series of shaped tabs and slots. In each case, it is believed that the resulting structure may be made lighter and easier to assemble, or may be pre-packaged in a smaller, easier to carry package. In furniture of this type, it is desirable to reduce the weight and bulk of the components, while at the same time increasing the strength and stability of the assembled product. Furthermore, it is desirable that assembly of the article of furniture be sufficiently uncomplicated so that a person could assemble the furniture article with little or no instructions.

SUMMARY OF THE INVENTION

Generally speaking, there is provided an apparatus and method for constructing furniture from a lightweight, rigid and foldable material such as fiberboard or cardboard where the components are in a substantially flat and compact storage condition and may be assembled therefrom into a substantially rigid furniture piece.

An article of collapsible furniture includes a top member and a base having multiple panels, each of the panels being hingedly connected to at least one other of the panels, and wherein the base has a collapsed storage condition wherein the panels are folded atop one another, and the base has an expanded load supporting condition wherein the panels are unfolded to form, in horizontal cross-section, a central load-supporting polygon, the polygon being a concave octagon. A connection assembly includes a series of slotted tabs that engage with a corresponding series of hooked slots to releasably lock the top member in a load supporting position atop the base.

It is another object of the present invention to provide an improved article of furniture that is assembled from a generally flat, folded condition.

It is further object of the present invention to provide an improved article of paperboard furniture.

Further objects and advantages of the present invention will become apparent from the following description of the preferred embodiment.

DESCRIPTION OF THE PREFERRED EMBODIMENT

Figure 1:
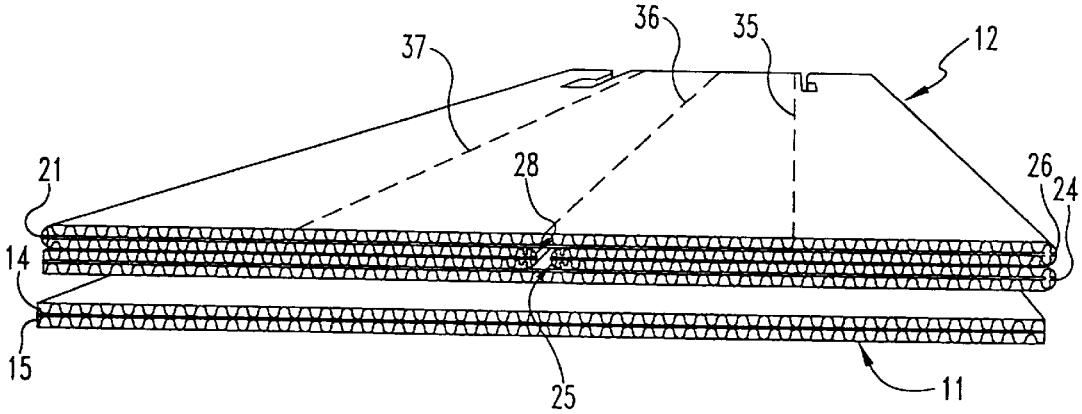
FIG. 1 is a perspective view of an article of collapsible furniture 10 in accordance with the preferred embodiment of the present invention, and shown in the collapsed condition.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

As used herein, the term cardboard refers to the corrugated paperboard construction generally comprising a pair of flat, parallel, and paperboard sheets with a third paperboard sheet interposed therebetween in a generally sinusoidal or triangular ripple pattern. The two outer sheets are typically bonded to the central rippled sheet with an appropriate adhesive. The resulting, generally planar structure is more resistant to bending than would be the three paperboard sheets simply stacked and glued flat together, and is more resistant to bending in a direction across the grain than with the grain. As used herein, the grain is generally considered as being lengthwise along the individual sinusoidal or similarly shaped ripples of the center sheet. It is understood that the term cardboard may also refer to other paper products that are stiffened by other means, and the present invention contemplates being manufactured from these or other materials that would provide sufficient rigidity to support a person or persons or articles for which it is intended. Included in such other materials are any of the variety of synthetic materials such as plastic and fiberglass, whether in a corrugated configuration or not. Nevertheless, the preferred embodiment of the present invention contemplates the use of corrugated paperboard as shown herein and as referred to herein generally as cardboard.

Referring now to FIGS. 1–8, there is shown an article of knockdown or collapsible furniture 10 in accordance with the preferred embodiment of the present invention. In this embodiment, the article of furniture 10 is shown and described as a seat (also referenced by the number 10), but the invention is applicable to other furniture items, at least one alternative embodiment of which is shown in FIGS. 12–19 and described hereinbelow. Seat 10 generally includes a seat member 11 and a base 12. In its collapsed storage condition (FIG. 1), base 12 is folded to a flat, stackable condition which, along with flat seat member 11, has a generally square profile and may be easily stored and transported. As used herein, the term "flat" or the phrase "flat, stackable condition" refers to configurations where the panel members are disposed in substantially mutually parallel planes and are in a generally back-to-back configuration as shown, for example, in FIG. 1, and as opposed to an expanded condition as shown, for example, in FIG. 3. Seat member 11 comprises upper and lower, square and flat pieces of cardboard 14 and 15, respectively, that are fixedly connected to each other by appropriate means such as by glue. The grains of cardboard pieces 14 and 15 are oriented orthogonally to each other to enhance their combined resistance to bending in all directions and to provide sufficient strength, along with base 12, to support a person sitting thereon. The thickness of the cardboard used for pieces 14 and 15 is preferably about 0.125 inches. However, the thickness of cardboard pieces 14 and 15 may be made dissimilar and may be of alternative thickness and composition to achieve a desired strength, weight or other characteristic.

Figure 2:
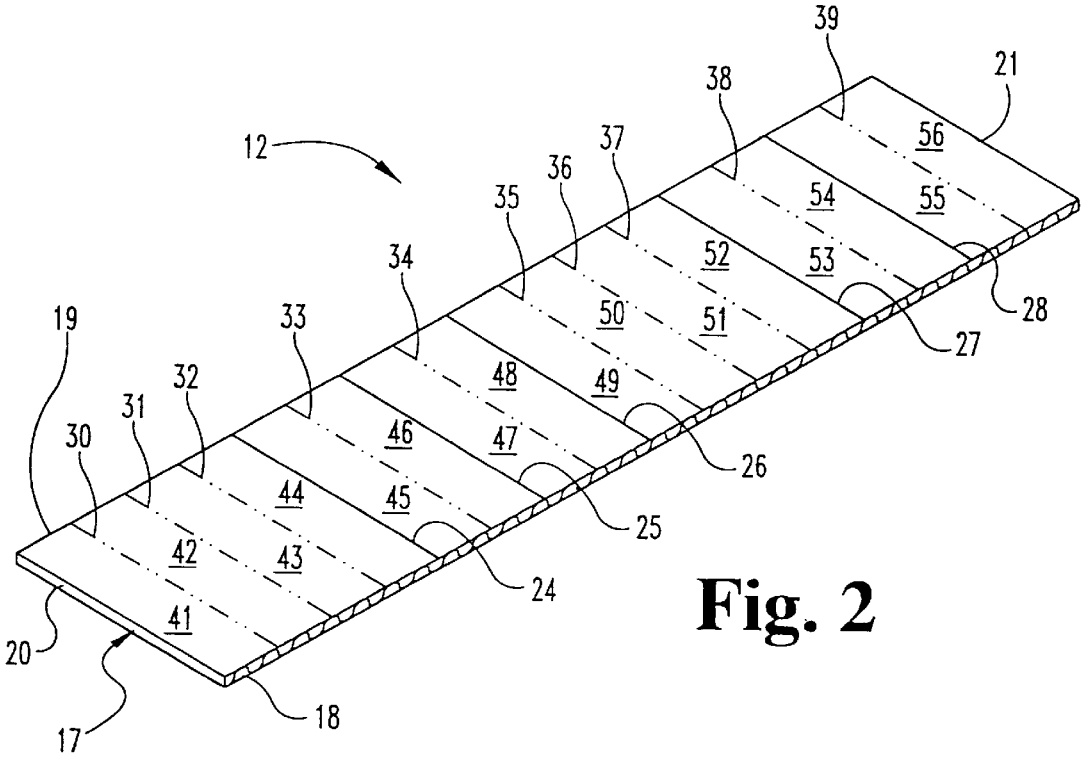
FIG. 2 is perspective view of the base 12 of the article of furniture 10 of FIG. 1, and shown in the flat, unfolded condition.

Base 12 is made from a single rectangular sheet of cardboard 17 as shown in FIG. 2. Sheet 17 defines opposing lower and upper long edges 18 and 19, respectively, and opposing short edges 20 and 21. The grain of sheet 17 is parallel to short edges 20 and 21. Primary creases 24–28 are mutually parallel and are made in sheet 17, as shown in FIG. 2, so that sheet 17 may be folded along lines parallel to the grains and at creases 24–28 to its flat storage condition shown in FIG. 1. Secondary creases 30–39 are made in sheet 17 parallel to creases 24–28, all of which are thus parallel to the opposing short edges 19 and 20. Creases 24–28 and 30–39 together define sixteen identically sized rectangular panels 41–56. Creases 25, 28 and 30–39 essentially act as joints to permit panels common thereto to hingedly pivot about such creases. Specific ones of panels 41–56 are connected together by appropriate means such as gluing so that, in conjunction with the pivotal bending about creases 25, 28, and 30–39, base 12 can be opened from its collapsed storage condition of FIG. 1 to its expanded, load supporting condition shown in FIGS. 3 and 4. Specifically, panels 41 and 56 are glued back to back and mutually form a radially extending support leg 59. Likewise, panels 44 and 45, panels 48 and 49, and panels 52 and 53 are glued back to back to form radially extending support legs 60, 61, and 62, respectively.

Referring to FIGS. 3 and 5–8, identically shaped seat connection slots 65–68 are defined at the top of, and extend downwardly from the upper edges 69 of each of legs 59–62. Reference will now be made to just slot 65, it being understood that slots 66–68 are identically shaped. Slot 65 is generally defined by inner vertical edge 70, bottom edge 71, outer lower edge 72, horizontal locking edge 73, outer upper edge 74, and opposing outer and inner, upper beveled edges 75 and 76, respectively. The width of slot 65 at its lower portion, between opposing vertical edges 70 and 72 is approximately one and one half times the thickness of lower cardboard piece 15 of seat 11. The width of slot 65 at its upper portion, between opposing vertical edges 70 and 74 is approximately equal to the thickness of lower cardboard piece 15 of seat 11. This configuration of slot 65 defines an inwardly extending hook 78 that is bounded at its bottom by horizontal locking edge 73. The upper corner of hook 78 is cut off at an angle to define the outer, upper beveled edge 75, which is slightly larger than the opposing inner, upper beveled edge 76. Together, beveled edges 75 and 76 provide clearance to facilitate the entry of a locking tab as will be described herein. Slots 65–68 may be formed by cutting the specific shapes out of legs 59–62 after the particular panel pairs (41 and 56, 44 and 45, 48 and 49, and 52 and 53) are glued together, or they may be formed by cutting the individual slot shapes in each of the corresponding panels (41, 44, 45, 48, 49, 52, 53, and 56) of sheet 17 before it is folded and glued.

Figure 5:
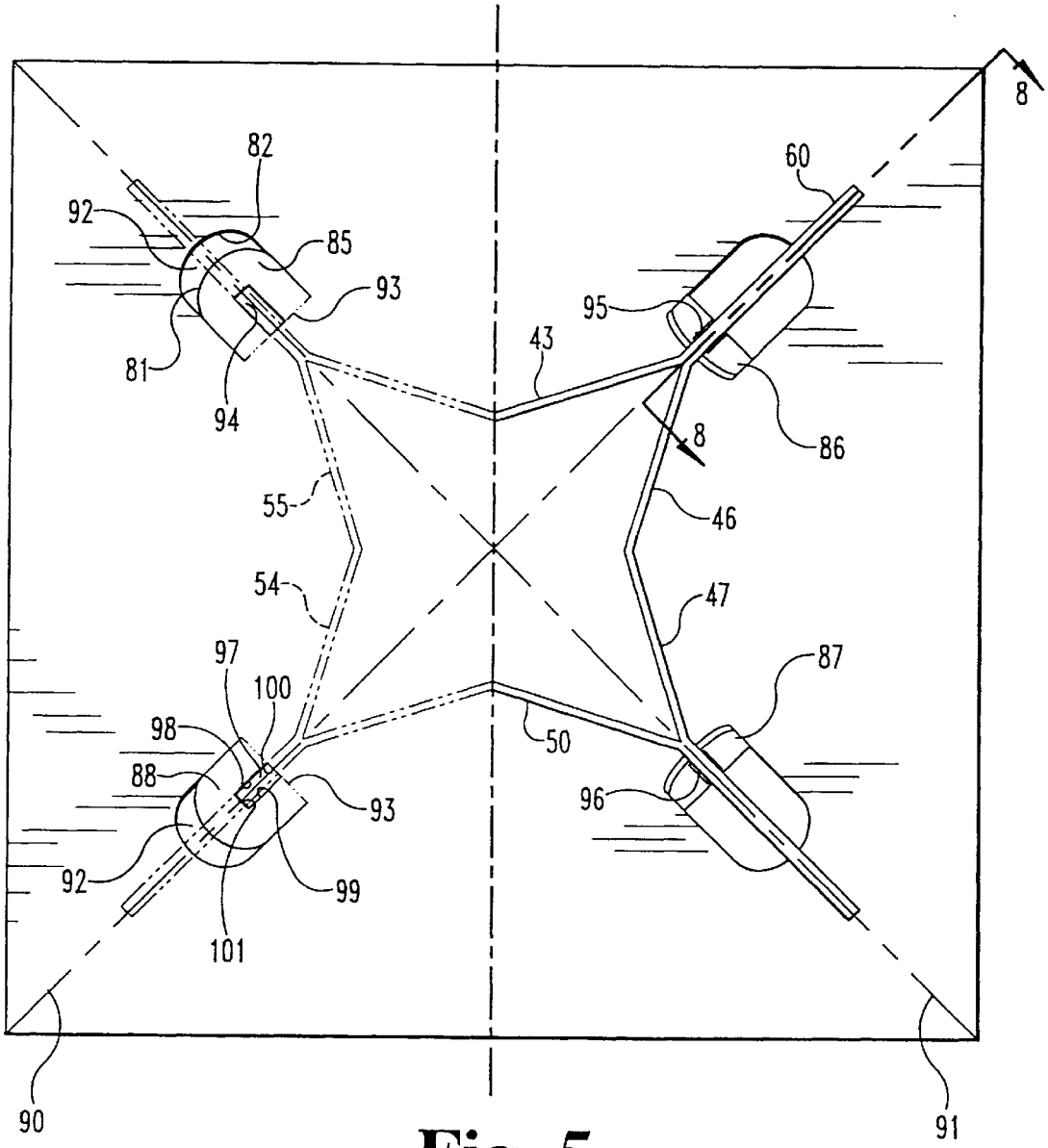
FIG. 5 is a plan view that a bottom, plan view of the article of collapsible furniture 10 of FIG. 1 drawing on the left half marking tabs and the flat storage condition and base 12 indicated that's shown in phantom and the right half is 12 and seat member 11 shown in the assembled condition.
Figure 6:
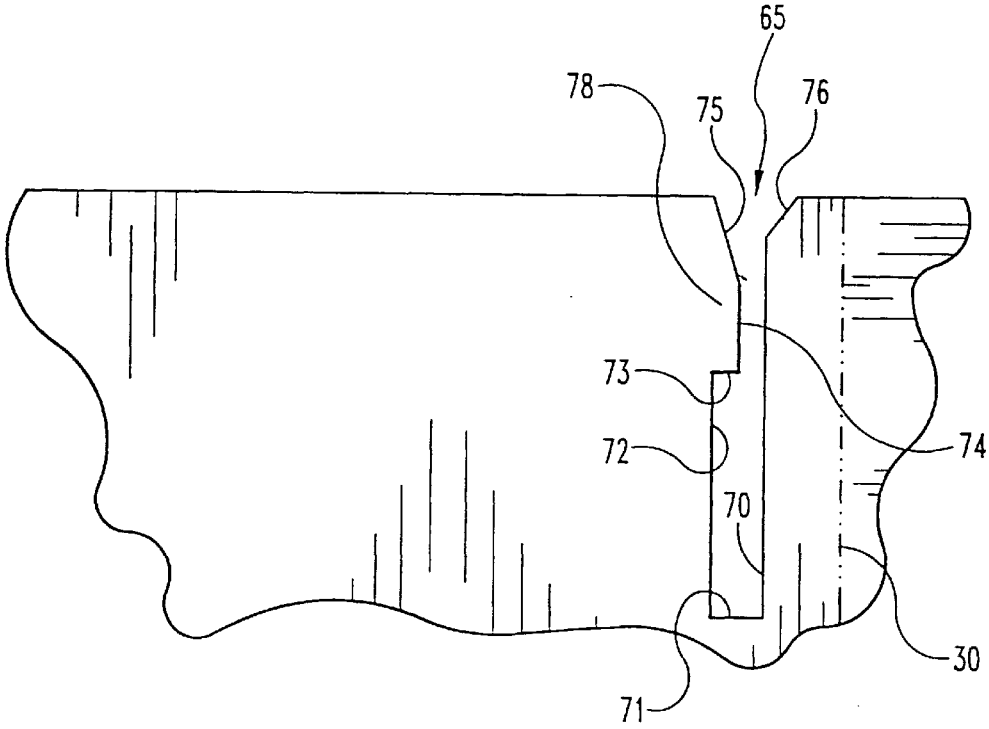
FIG. 6 is a side view of a portion of base 12 showing slot 65.
Figure 7:
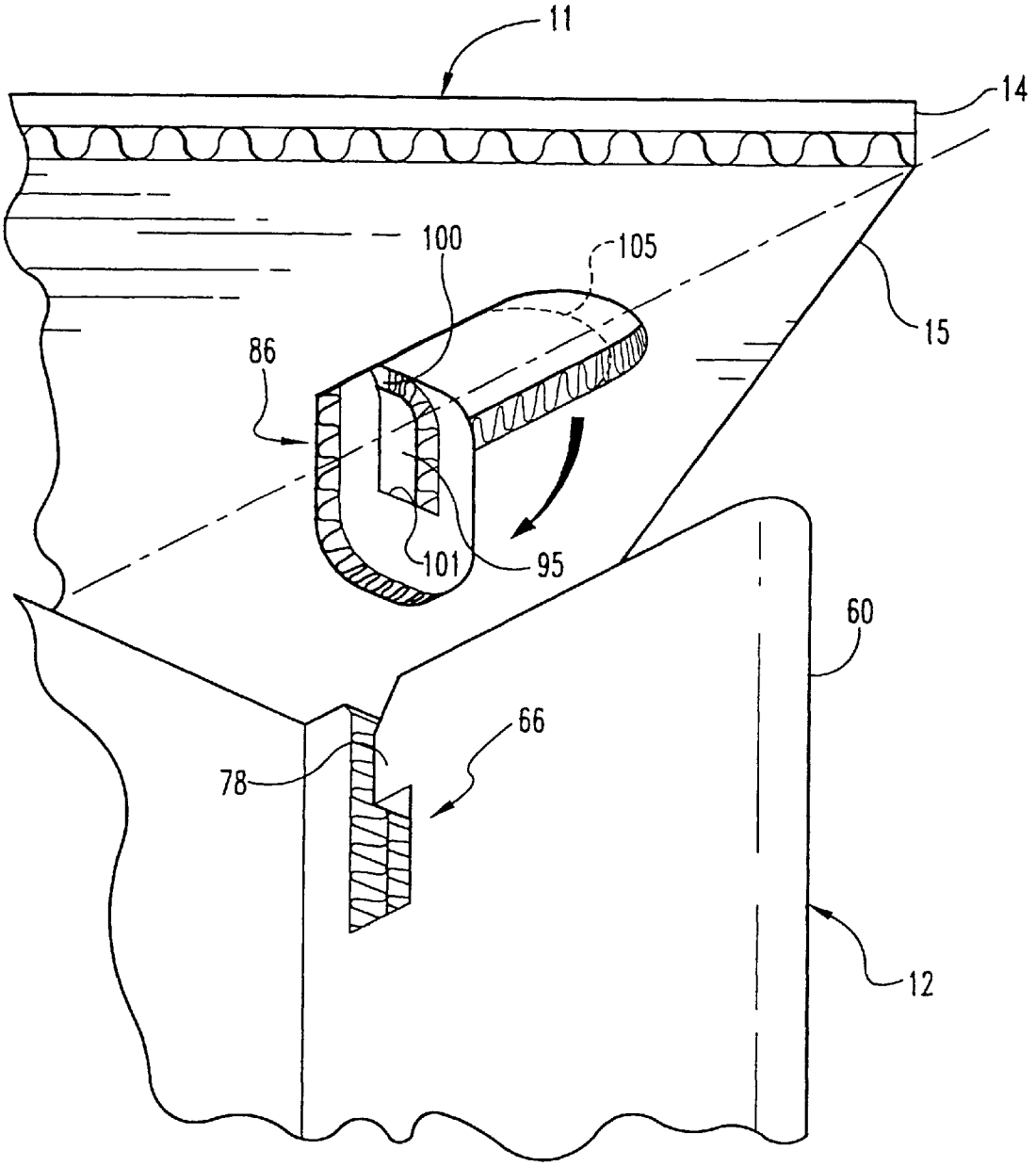
FIG. 7 is a perspective view of a portion of base 12 and seat member 11 and showing a locking tab 86 in the pre-assembly condition.

Referring to FIGS. 5 and 7, inner and outer generally U-shaped cuts 81 and 82 are made proximal to each of the four comers of lower cardboard piece 15 to define locking tabs 85–88. Each of the pairs of cuts 81 and 82 are centered along a corresponding diagonal line 90, 91 that extends from opposing corners of the square lower cardboard piece 15. Outer U-shaped cuts 82 extend approximately one half inch farther outwardly along their diagonal line (90 or 91) than inner U-shaped cuts 81 whereby crescent-shaped sections are thus defined and removed from lower cardboard piece 15, outwardly of each of tabs 85–88. The removal of the crescent-shaped sections creates a crescent-shaped finger access opening 92 at the outermost edge of each of tabs 85–88. A crease 93 is made, orthogonally to the corresponding diagonal, and at and between the innermost termini of each of the U-shaped cuts. Crease 83 thus creates a bend line to bend each tab 85–88 downwardly from the flat storage condition, whereby each tab 85–88 is substantially coplanar with the rest of cardboard piece 15 (left half of FIG. 5), to a pre-assembly condition whereby each tab 85–88 extends approximately 90° downwardly from the rest of cardboard piece 15, the pre-assembly condition being shown in FIG. 7. Alternative embodiments are contemplated wherein tabs 85–88 are separate pieces that are attached as by gluing to seat member 11. In this or similar configurations, the flat storage position includes tabs 85–88 being substantially coplanar, that is in the same plane or just above or below the plane of the seat member.

A rectangular section is cut out of each tab 85–88 to define hook receiving slots 94–97, respectively. Each slot 94–97 is centered over the corresponding diagonal 90 and 91 and is defined by opposing side edges 98 and 99 and opposing inner and outer edges 100 and 101, respectively. Inner edge 100 is located at or just outwardly of crease 93. The length of each slot 94–97, measured between inner and outer edges 100 and 101, is approximately equal to the vertical distance between upper edge 69 of a leg (59–62) and the horizontal locking edge 73 of a slot (65–68). The width of each slot 94–97, measured between side edges 98 and 99, is approximately equal to the thickness of each leg 59–62, that is, approximately twice the thickness of cardboard sheet 17.

Figure 3:
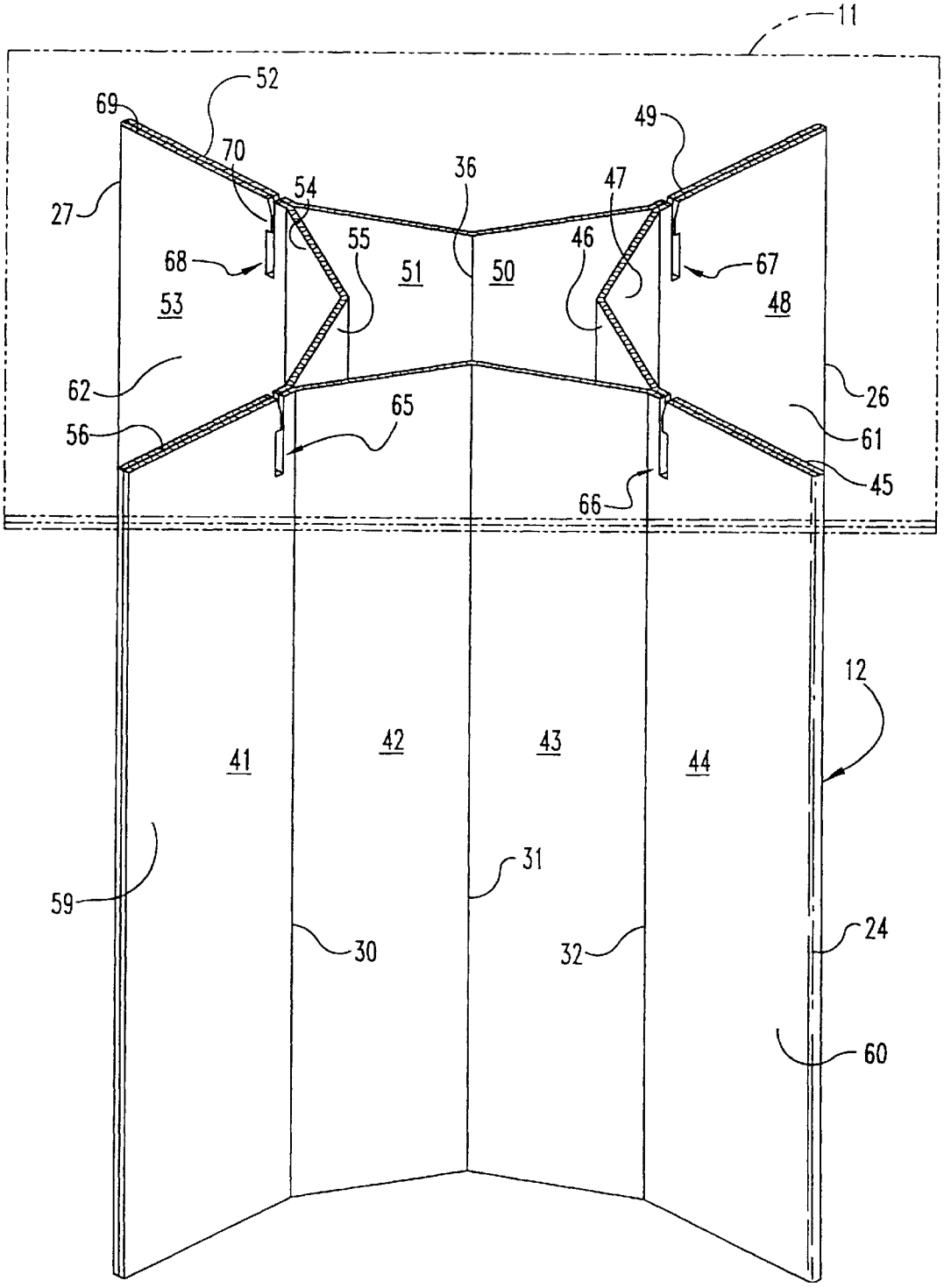
FIG. 3 is a perspective view of the base 12 of FIG. 2, and shown in the expanded, load supporting condition.
Figure 4:
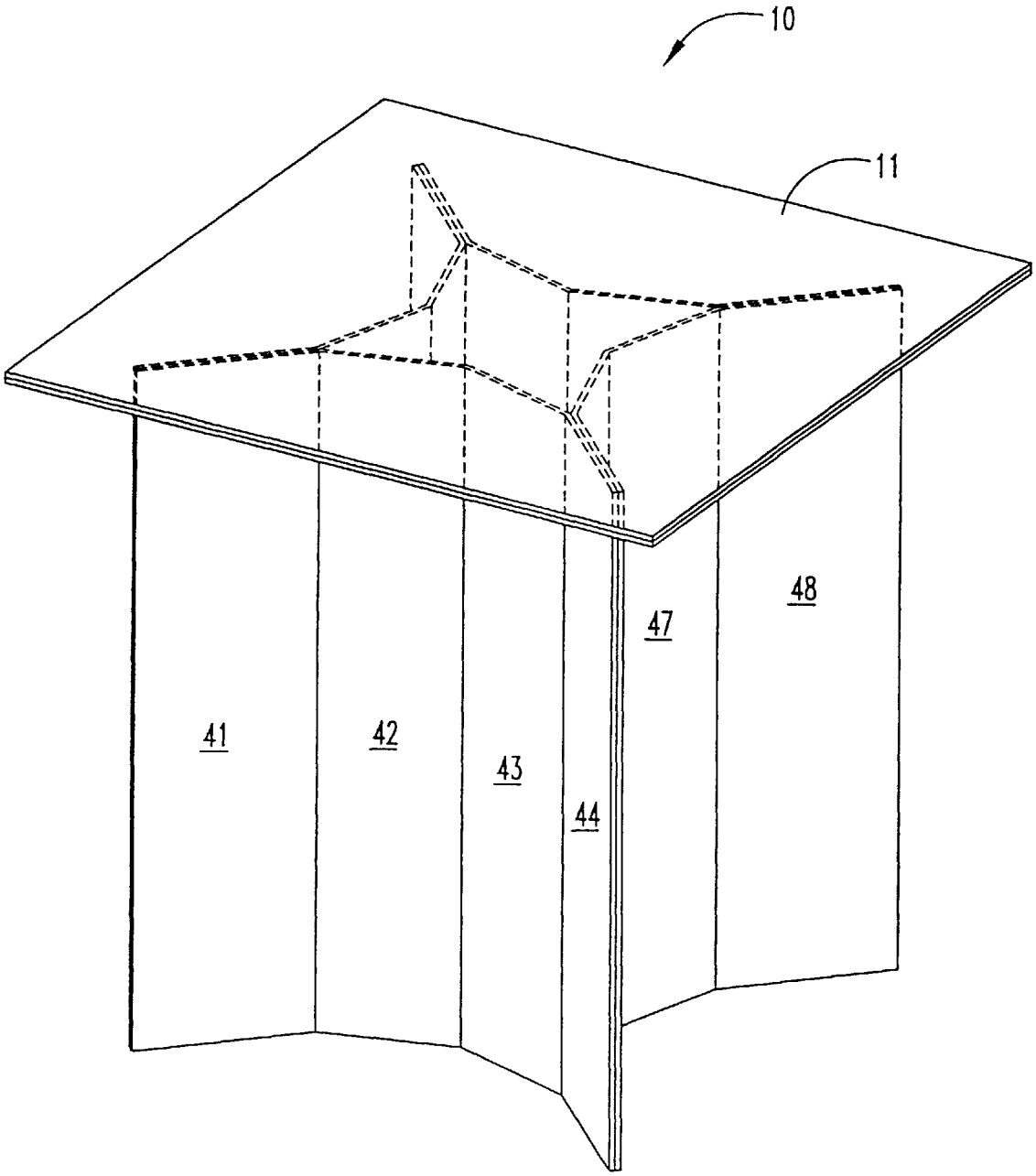
FIG. 4 is a perspective view of the article of furniture of FIG. 1, and shown in the assembled condition.

While base 12 has been described as being made from a single sheet of cardboard or similar material, it is understood that base 12 may be made from two or more appropriately cut pieces, glued together to achieve the collapsed storage configuration of FIG. 1 and the expanded, load supporting condition shown in FIGS. 3–5.

Figure 8:
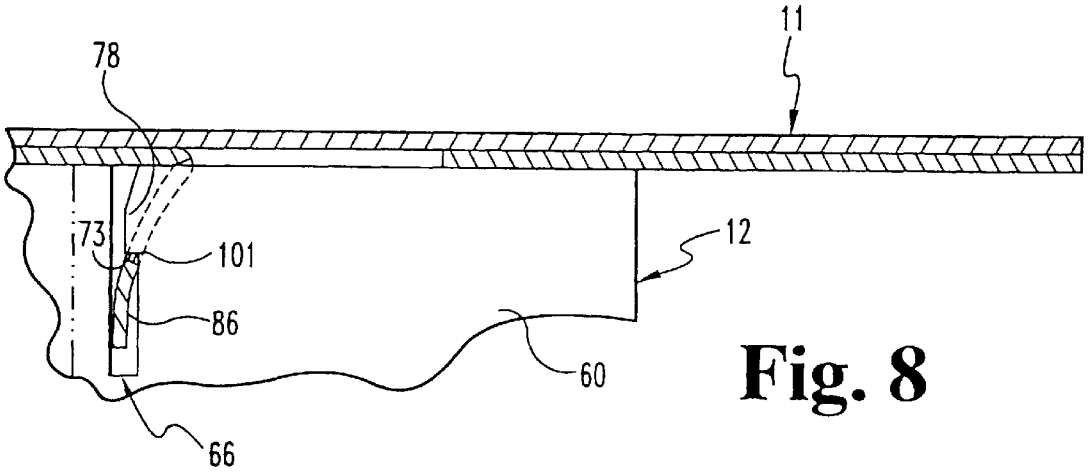
FIG. 8 is a view of a portion of seat member 11 in base 12 in the assembled condition and showing locking tab 86 engaged with seat connection slot 66.

In use, seat 10 operates as follows: in the collapsed, storage condition (FIG. 1), seat 10 comprises (in one embodiment) seat member 11 and base 12; measures approximately 16 inches square and approximately 0.75 inches thick total; and, weighs 21.5 ounces. To assemble seat 10, base 11 is expanded from its flat storage condition (FIG. 1) to its expanded, load supporting condition (FIGS. 3 and 4). Tabs 85–88 are bent along their corresponding creases 93 from their flat storage condition (left side of FIG. 5 and at 105 in FIG. 7) to their pre-assembly condition extending approximately 90° downwardly from the rest of cardboard piece 15 (FIG. 7). Seat member 11 is positioned atop base 12 (or, in the alternative, with seat member 11 inverted with tabs 85–88 extending up, base 12 is positioned atop seat member 11) and tabs 85–88 are, each, positioned within and locked one of the corresponding cutouts 65–68. Referring to FIG. 8 and tab 86, for example, this is done by inserting tab 86 down into corresponding cutout 66 until hook 78 of cutout 66 enters slot 95 of tab 86, releasably locking tab 86 to leg 60. The dimensions and locations of tabs 85–88 and cutouts 65–68 are provided so that, when tabs 85–88 are inserted into and releasably locked with their corresponding cutouts 65–68, tabs 85–88 are bent back slightly more than 90° (as shown in FIG. 8) from their mutually coplanar, storage conditions at 105. The cardboard or other material comprising piece 15 has some degree of elasticity, and tabs 85–88 therefore seek to return to their mutually coplanar storage conditions at 105. Furthermore, base 12 naturally seeks to return to or nearly to the collapsed storage condition of FIG. 1, which means that, when assembled and in the expanded load supporting condition of FIGS. 3 and 4, support legs 59–62 are biased substantially radially inwardly which, in turn, pulls the corresponding tabs 85–88 radially inwardly (to the left in FIG. 8, for example). Thus, in order for tabs 85–88 to be released from within cutouts 65–68, they must each be pulled inwardly even further and against their inherent outward, bias, and the corresponding leg 59–62 must be pulled generally radially outwardly (to the right in FIG. 8) to enable outer edge 101 to move clear horizontal of locking edge 73. This configuration resists tabs 85–88 from releasing from cutouts 65–68 spontaneously.

In the configuration described herein, base 12 could be expanded and held so that non-glued, central panels 42, 43, 46, 47, 50, 51, 54 and 55 form a square in cross-section. However, in the preferred embodiment, base 12 is manufactured to retain the flat storage condition of FIG. 1 upon removal from any packaging, and it must be manually pulled into the expanded load supporting condition of FIG. 3. After one or more assemblies of base 12, as described below, base 12 will preferably retain some inherent structural bias to return toward the flat storage position of FIG. 1 rather than to stay in the expanded condition of FIG. 3. Because base 12 inherently seeks to return toward the collapsed storage condition, when base 12 is expanded and assembled with seat member 11, central panels 42, 43, 46, 47, 50, 51, 54 and 55 form a simple, concave polygon (an octagon). That is, the contours (panels) of the polygon have no self-intersections (hence "simple"), and not all of the diagonals of the polygon lie inside the polygon (i.e. a horizontal line from crease/vertex 31 to crease/vertex 36 lies within the polygon; but a horizontal line from crease/vertex 32/33 to crease/vertex 30/39 lies outside of the polygon) (hence "concave"). The resulting octagon forms a generally four-pointed star in horizontal cross-section. This configuration enhances the strength of base 12 and its resistance to buckling under the weight of someone sitting on seat 10. Other configurations of the present invention are contemplated wherein the resulting central supporting, simple polygon has other shapes. For example, a base having three legs and a resulting central supporting polygon having just six panels is contemplated. Also contemplated is a central polygon that is convex—that is, whose diagonals all lie within the polygon, such as, for example, an equilateral hexagon or an equilateral octagon.

Seat 10 may be disassembled by removing each of tabs 85–88 from cutouts 65–68, bending tabs 85–88 back to their storage condition, and collapsing base 12 to its generally flat, collapsed storage condition of FIG. 1.

Figure 9:
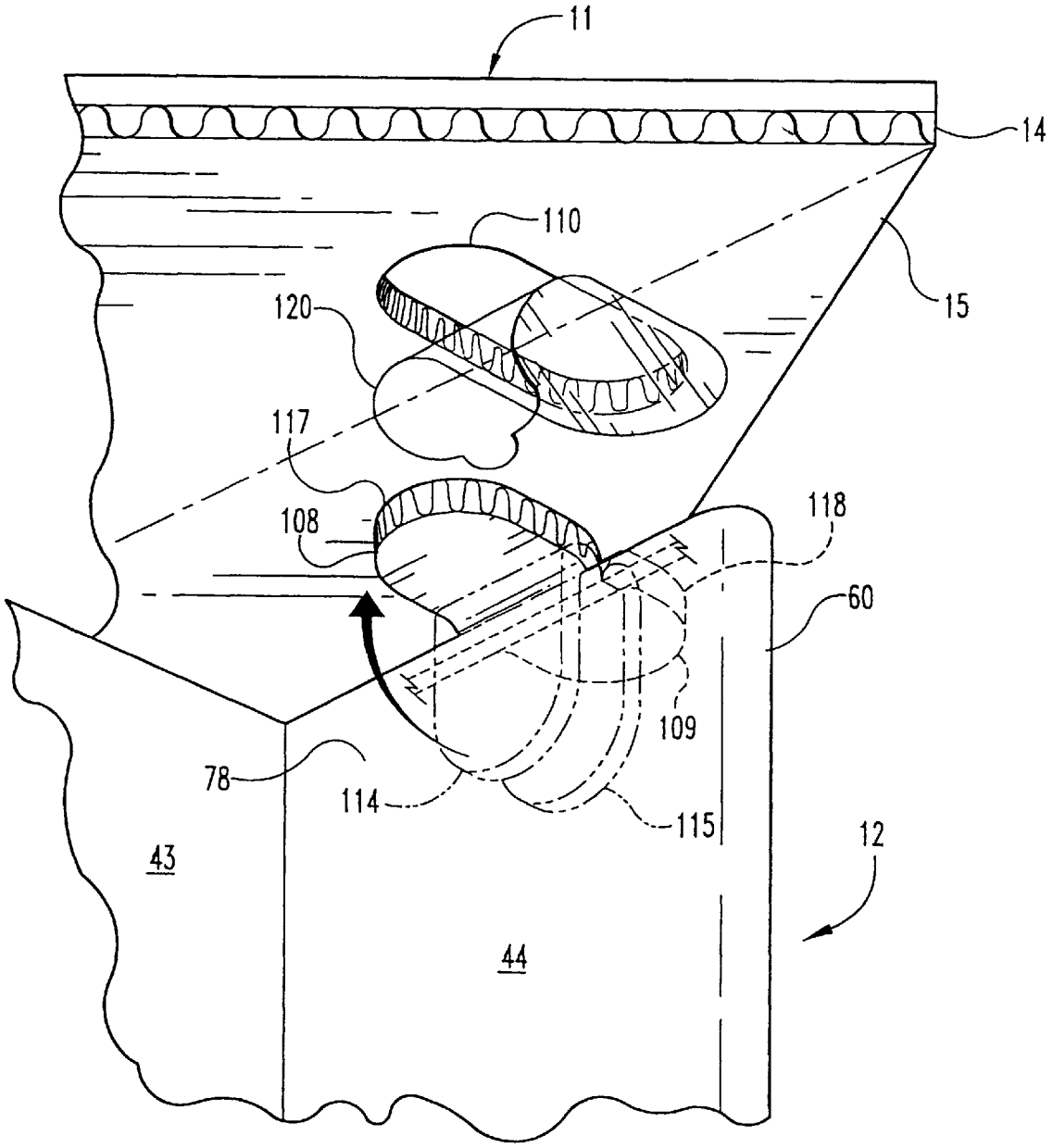
FIG. 9 is a perspective view of a portion of seat member 11 in base 12 in accordance with another embodiment of the present invention to the manner of securing base 12 to seat member 11.
Figure 10:
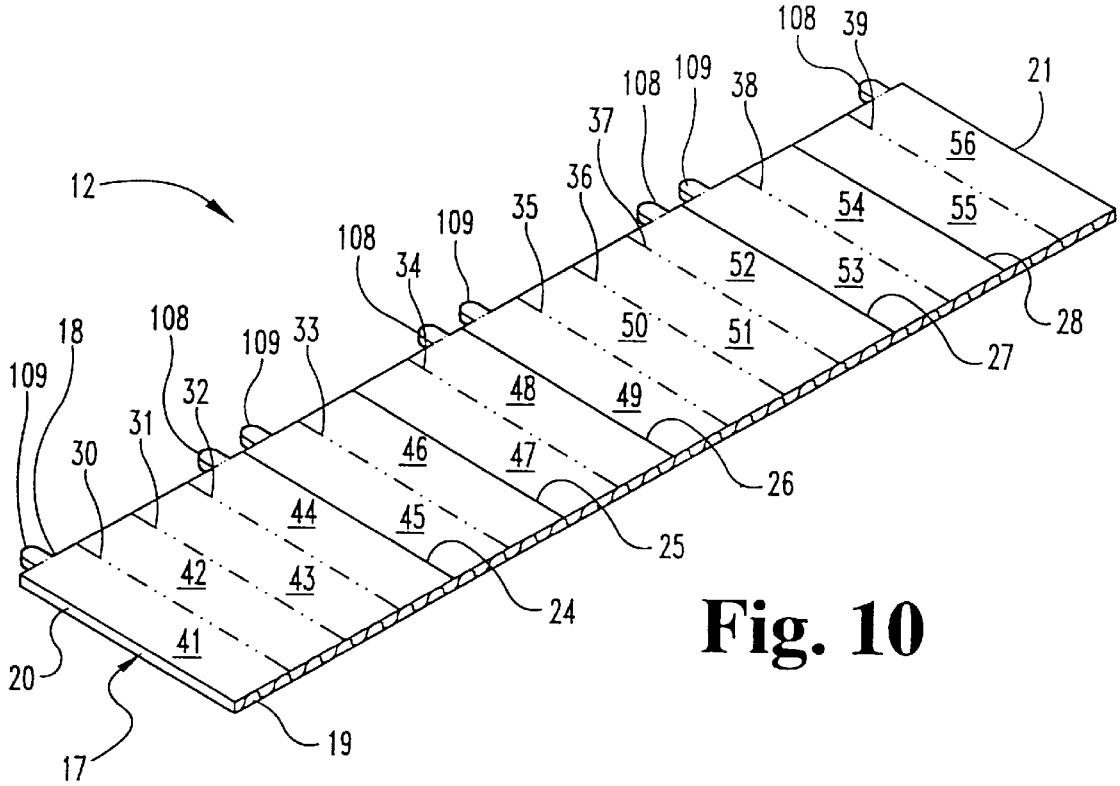
FIG. 10 is a perspective view of the base 12 of part of an embodiment of FIG. 9, and shown in the flat, unfolded condition.
Figure 11:
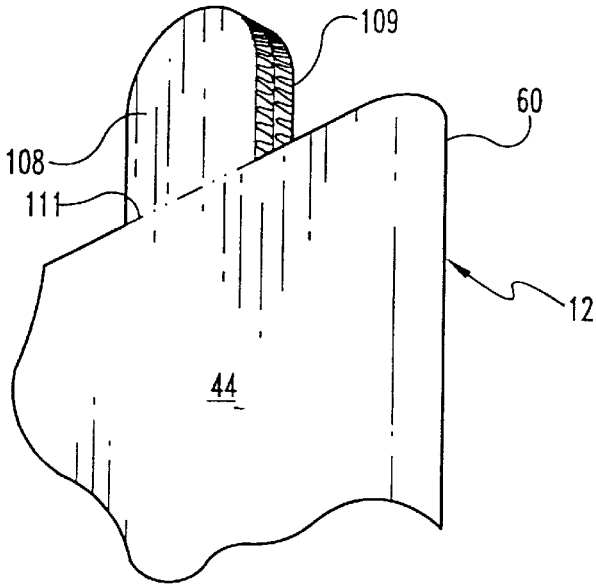
FIG. 11 is a perspective view of a portion of leg 60 of base 12 of FIG. 10.

Referring to FIGS. 9–11, there is shown an alternative method for securing seat member 11 to base 12. Instead of the slot (65–68) and tab (85–88) combination of FIGS. 1–8, each leg 59–62 the embodiment of FIGS. 9–11 is provided with a pair of bendable tabs 108 and 109 extending upwardly from each radially extending support leg 59–62. A corresponding oval-shaped slot 110 is defined in lower cardboard piece 15 of seat member 11. More specifically, the sheet 17 which comprises base 12 is originally formed with four pairs of tabs 108 and 109 extending outwardly from upper edge 18 and from panels 44 and 45, 48 and 49, 52 and 53, and 56 and 41, as shown in FIG. 10. The four pairs of tabs 108 and 109 extending outwardly from sheet 17 are aligned with respect to the corresponding panels so that when sheet 17 is folded and glued into the configuration shown in FIG. 3, each pair of tabs 108 and 109 align with each other, as shown in FIG. 11. When the four pairs of panels 44 and 45, 48 and 49, 52 and 53, and 56 and 41 are glued together as described above, no adhesive is applied to the pairs of tabs 108 and 109 so that each of the four pairs of tabs 108 and 109 may be bent along a crease 111 to a storage condition (shown at 114 and 115). Tabs 108 and 109 may then be bent along creases 111 from the storage condition (at 114 and 115) to pre-assembly condition (at 117 and 118) whereby tabs 108 and 109 are substantially coplanar and define an oval-shaped configuration. Slot 110 is of complementary size and shape to the oval-shaped configuration of the tabs 108 and 109 in the pre-assembly condition, as shown in FIG. 9.

When upper and lower cardboard pieces 14 and 15 are manufactured, an appropriate adhesive substance (not shown) is applied to upper cardboard piece 14 so that such adhesive is exposed through slot 110. A protective film 120 is applied to lower piece 15 to cover slot 110 and protect the adhesive therein from contamination and deterioration prior to usage.

In use, after base 12 is expanded and ready to be secured with seat member 11, the four pairs of tabs are pivoted at creases 111 from their storage conditions 114 and 115 to their pre-assembly conditions 117 and 118. Protective film 120 is removed from lower cardboard piece 15 to expose slot 110 and the adhesive therein. Seat member 11 and base 12 are then brought together and each pair of tabs 108 and 109 is firmly seated within its corresponding and complementary shaped slot 110 so it engages with the adhesive and bonds tabs 108 and 109 to the bottom of upper cardboard piece 14, thereby bonding base 12 with seat member 11.

The adhesive used within slots 110 may be of any suitable type which retains a desired level of adhesion and which provides sufficient bonding to firmly secure tabs 108 and 109 within their corresponding slots 110. Such adhesive could be chosen so that tabs 108 and 109 are substantially permanently bonded to seat member 11, thus strongly bonding seat member 11 in place with base 12, but destroying the ability to knockdown and reuse the furniture article. Alternatively, such adhesive could permit the removal of tabs 108 and 109 from seat member 11, without removing the adhesive material from within slot 110 or destroying its adhesive quality, and thus enabling the furniture article to be disassembled and reused. Alternative embodiments are also contemplated wherein the adhesive action between tabs 108 and 109 and seat member 11 is accomplished by treating just tabs 108 and 109 with an appropriate adhesive or by treating both tabs 108 and 109 and seat member 11 with an appropriate substance or material that causes adhesion between tabs 108 and 109 and seat member 11 when tabs 108 and 109 are brought in contact with seat member 11 within slot 110. It should be understood that appropriate forms of adhesion between these members may be accomplished with materials other than adhesive compounds such as glue or tape-like substances, for example, Velcro®. In this vein, alternative embodiments are contemplated wherein a slot 110 is replaced by an alternative structure, mechanism or substance which provides the connection and positionment of tabs 108 and 109 relative to seat member 11. Alternative embodiments are contemplated wherein seat member 11 has a shape other than a square. Alternative embodiments are contemplated wherein panels 41–46 are not substantially identical. For example, the panels 41,44,45,48,49,52,53 and 56 that form legs 59–62 may be made wider or of a different shape than the panels 42, 43, 46, 47, 50, 51, 54 and 55 that form the central supporting polygon. Alternative embodiments are also contemplated wherein two or more bases 12 may be used in conjunction with a larger seat member 11 to form a bench, or to form a table.

Figure 14:
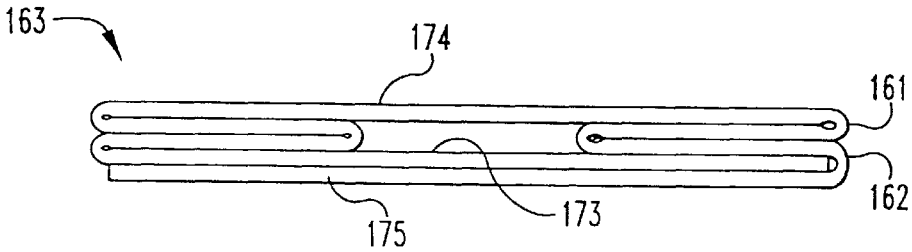
FIG. 14 is an end view of the table top support 163 of table top 131 of the table 130 of FIG. 12.
Figure 15:
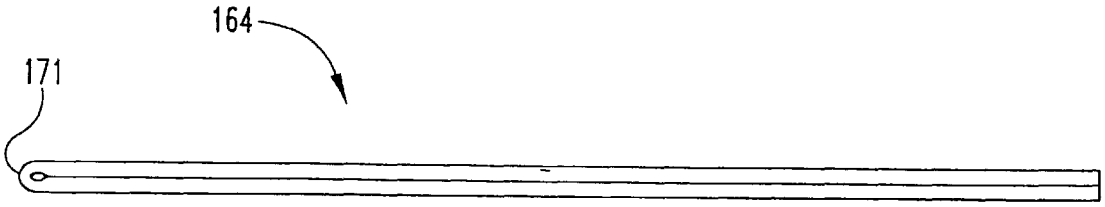
FIG. 15 is an end view of the cover member 164 of table top 131 of table 130 of FIG. 12.
Figure 16:
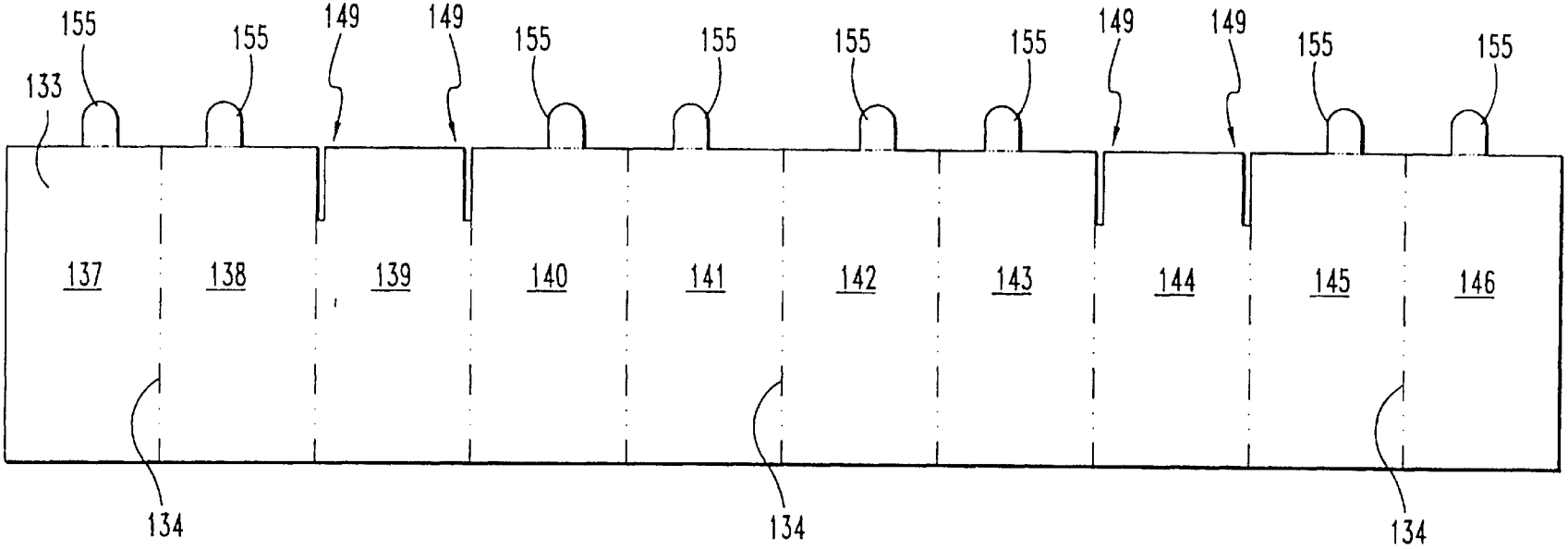
FIG. 16 is a perspective view of the base 132 of the table 130 of FIG. 12, and shown in the flat, unfolded position.
Figure 17:
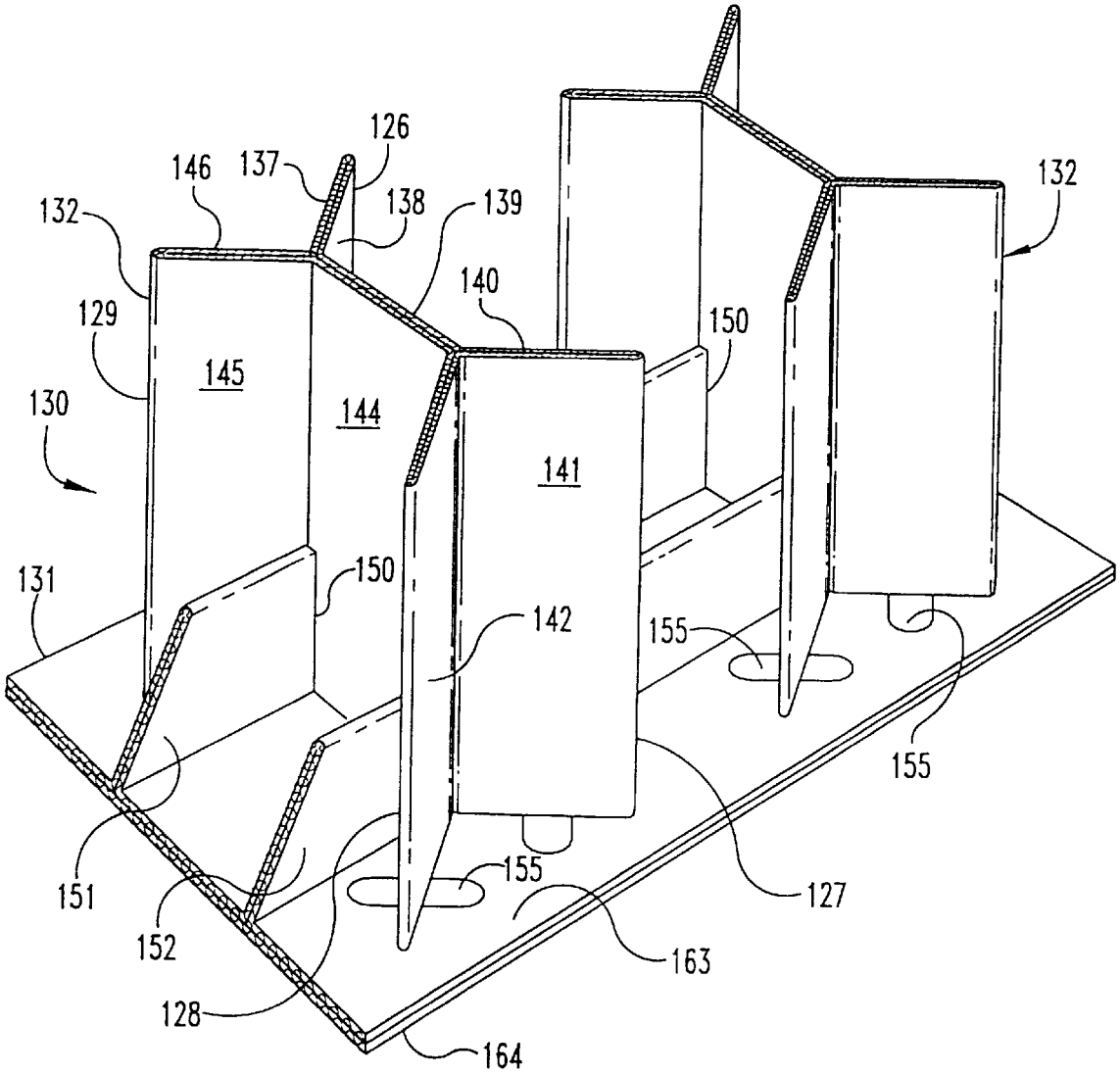
FIG. 17 is a perspective view that is a bottom perspective view of the table 130 of FIG. 17.

Referring to FIGS. 12–19, there is shown an article of knockdown or collapsible furniture made from cardboard in accordance with another embodiment of the present invention. In this embodiment, the furniture article is shown and described as a table 130. Table 130 generally includes a table top 131 and a base 132. Like base 12 of seat 10, base 132 is foldable from a collapsed storage condition (FIG. 13) to an expanded support condition (FIG. 17). Referring to FIG. 16, base 132 is constructed of a single sheet 133 and is provided with a number of creases 134 to enable sheet 133 to be folded at creases 134 into a table base 132 in the configuration shown in FIG. 17. The creases 134 divide sheet 133 into ten substantially identically sized and rectangular panels 137–146. Specific panel pairs are secured back to back with each other with an appropriate adhesive. That is, referring to FIG. 17, the following panel pairs are secured to each other back to back: 137 and 138; 140 and 141, 142 and 143; and, 145 and 146. This configuration enables base 132 to be folded to the collapsed storage condition shown in FIG. 13 and to be unfolded into the expanded table top support condition shown in FIG. 17. With the panel pairs 137/138, 140/141, 142/143, and 145/146 bonded to each other, support legs 126–129, respectively, are thereby formed. Sections 149 are cut out of opposing sides and at the top of panels of 139 and 144 (FIG. 16) which, when base 132 is unfolded to the expanded support condition of FIG. 17, defines a pair of slots (one shown at 150) in the resulting center, combination panel 139/144. These resulting slots 150 are sized and configured to receive therein the longitudinal support beams 151 and 152 described below.

As with the embodiment of seat member 11 and base 12 of FIGS. 9–11, base 132 is cut to define a plurality of tabs 155 extending upwardly from selected panels, specifically, panels 137, 138, 140, 141, 142, 143, 145, and 146, as shown in FIG. 16. When sheet 133 is folded and glued together to form the table base 132 shown in FIG. 17, the tabs 155 extending upwardly from the base 132 form pairs of locking tabs that operate like those of FIGS. 9–11.

Figure 13:
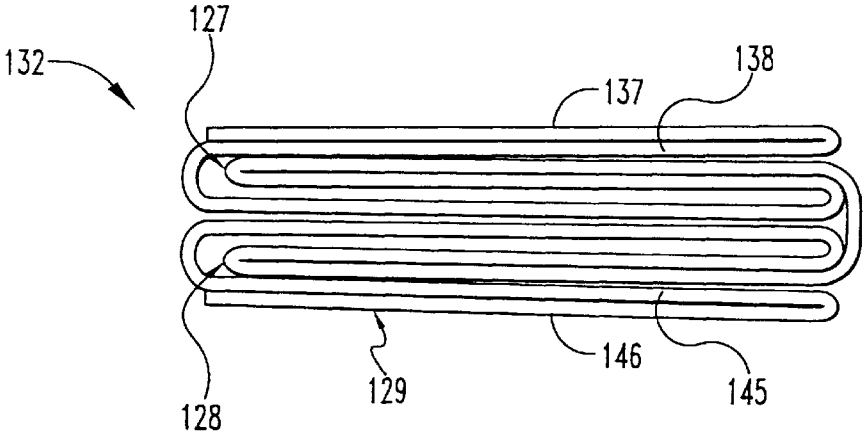
FIG. 13 is an end view of base 132 of table 130 of FIG. 12.

In the preferred embodiment, the width of center, combination panel 139/144 is slightly greater than the width of legs 126–129 to enable legs 126–129 to be folded to the collapsed storage position as shown in FIG. 13.

Figure 18:
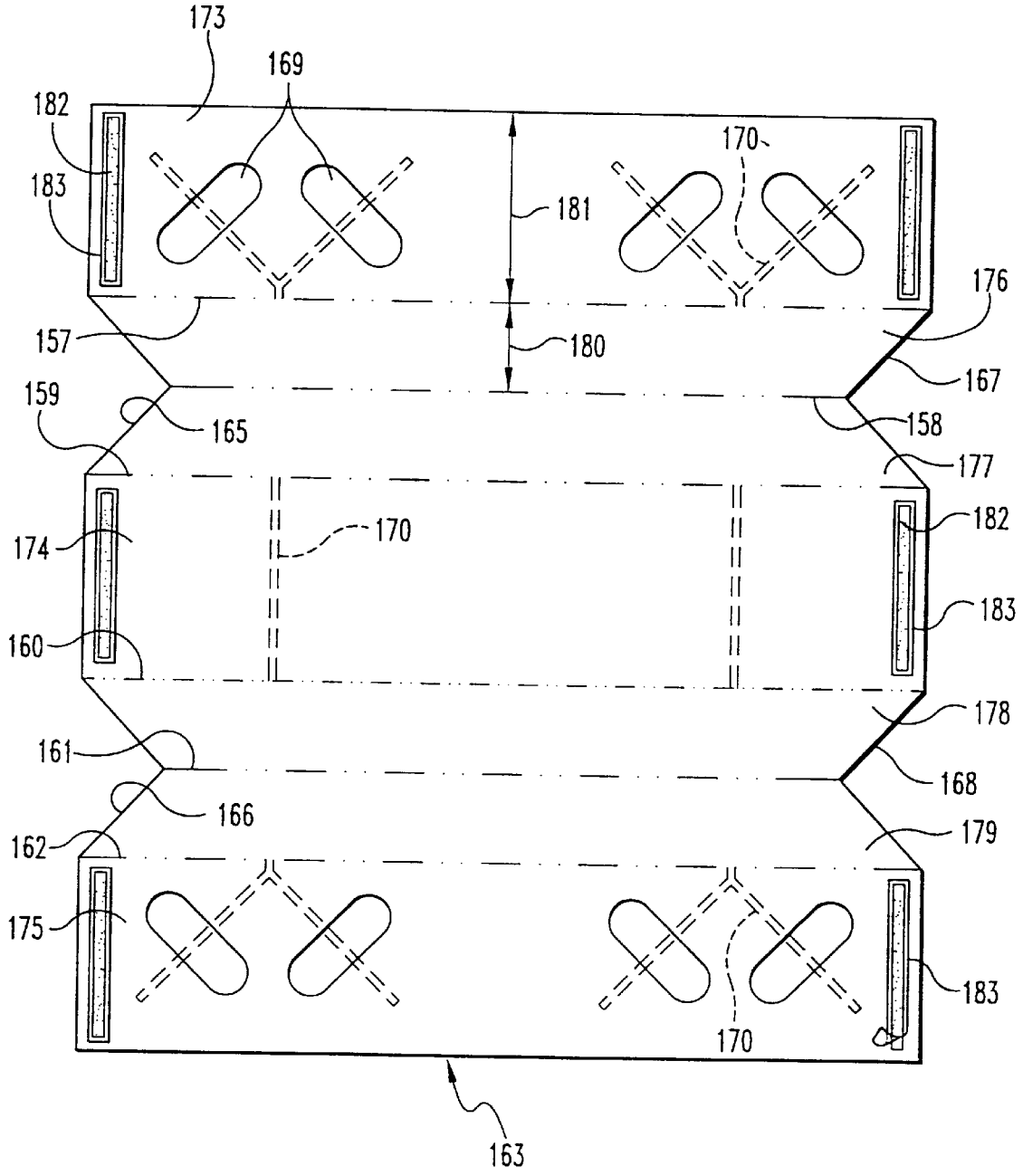
FIG. 18 is a plan view of table top support 163 shown in the flat, unfolded condition.
Figure 19:
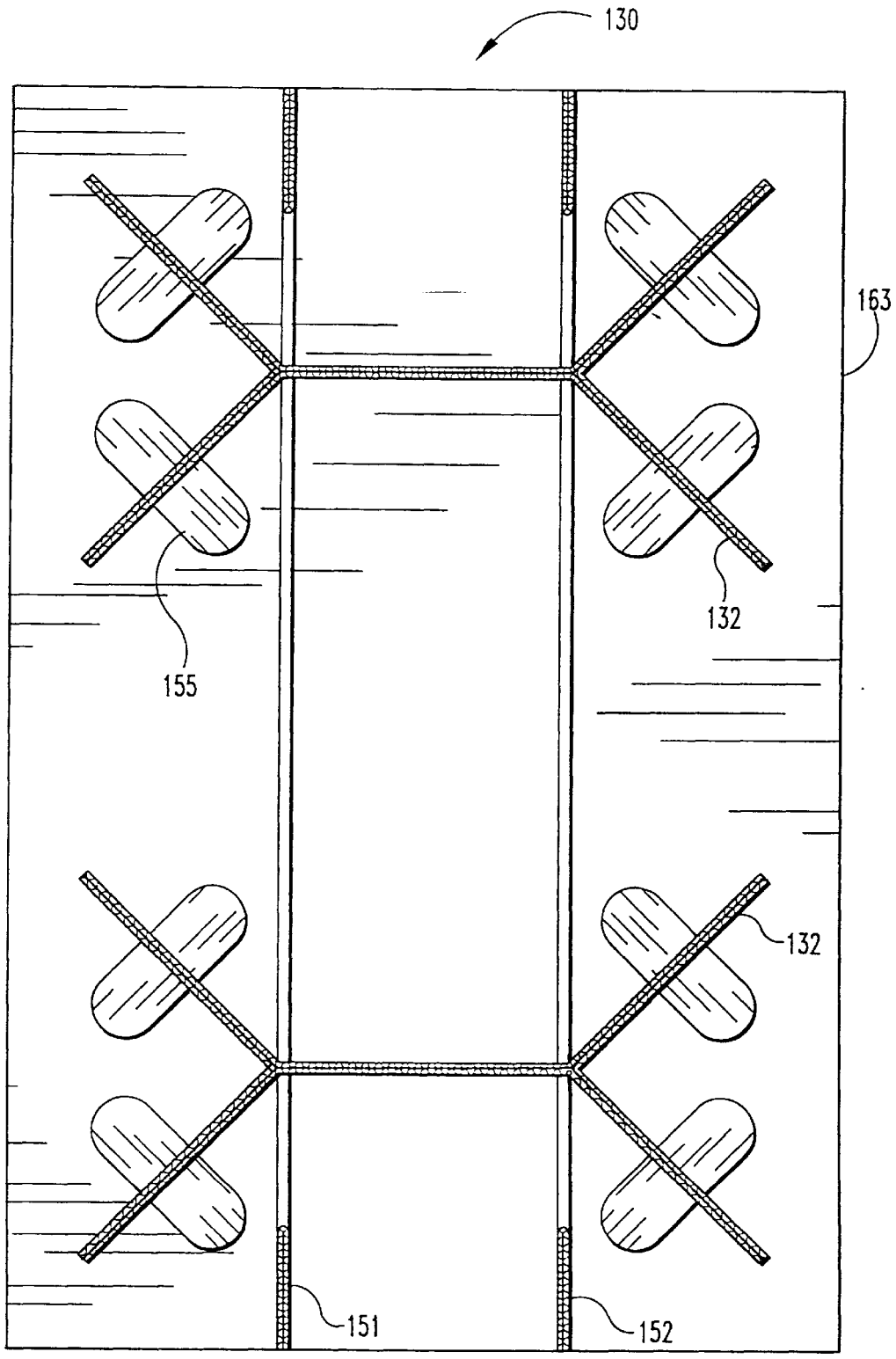
FIG. 19 is a bottom of table 130.

Table top 131 comprises a table top support 163 and a cover member 164. Referring to FIGS. 14 and 18, table top support 163 is formed from a single sheet 156 cut as shown, and is provided with a plurality of mutually parallel creases 157–162. Creases 157–162 define three substantially identically shaped, rectangular table sections 173–175 and two pairs of table beam sections 176–179. Portions of sheet 156 are cut out to define V-shaped sections 165–168 on opposing sides of sheet 156. The V-shaped sections 165–168 are identically shaped, and the length of the edges of V-shaped sections 165–168 and the angles formed thereby are identical and are bounded by creases 157–162, as shown. In the preferred embodiment, the width 180 of the table beam sections 176–179 is between one third and one half of the width 181 of the outer table sections 173 and 175.

Like the oval slots 110 defined in lower cardboard piece 15 of FIG. 9, sheet 156 is provided with eight oval slots 169, placed as shown in FIG. 18. The locations of the eight slots 169 are set to correspond with the location of tabs 155 of base 132. That is, upon assembly of table 130, when base 132 is secured to table top 131, the pairs of tabs 155 will correspond to and be firmly seated within slots 169. The general positionment of base 132 relative to table top 131 is indicated in dashed lines at 170 on sheet 156 in FIG. 18 and is shown in the bottom view of assembled table 130 in FIG. 19.

Figure 12:
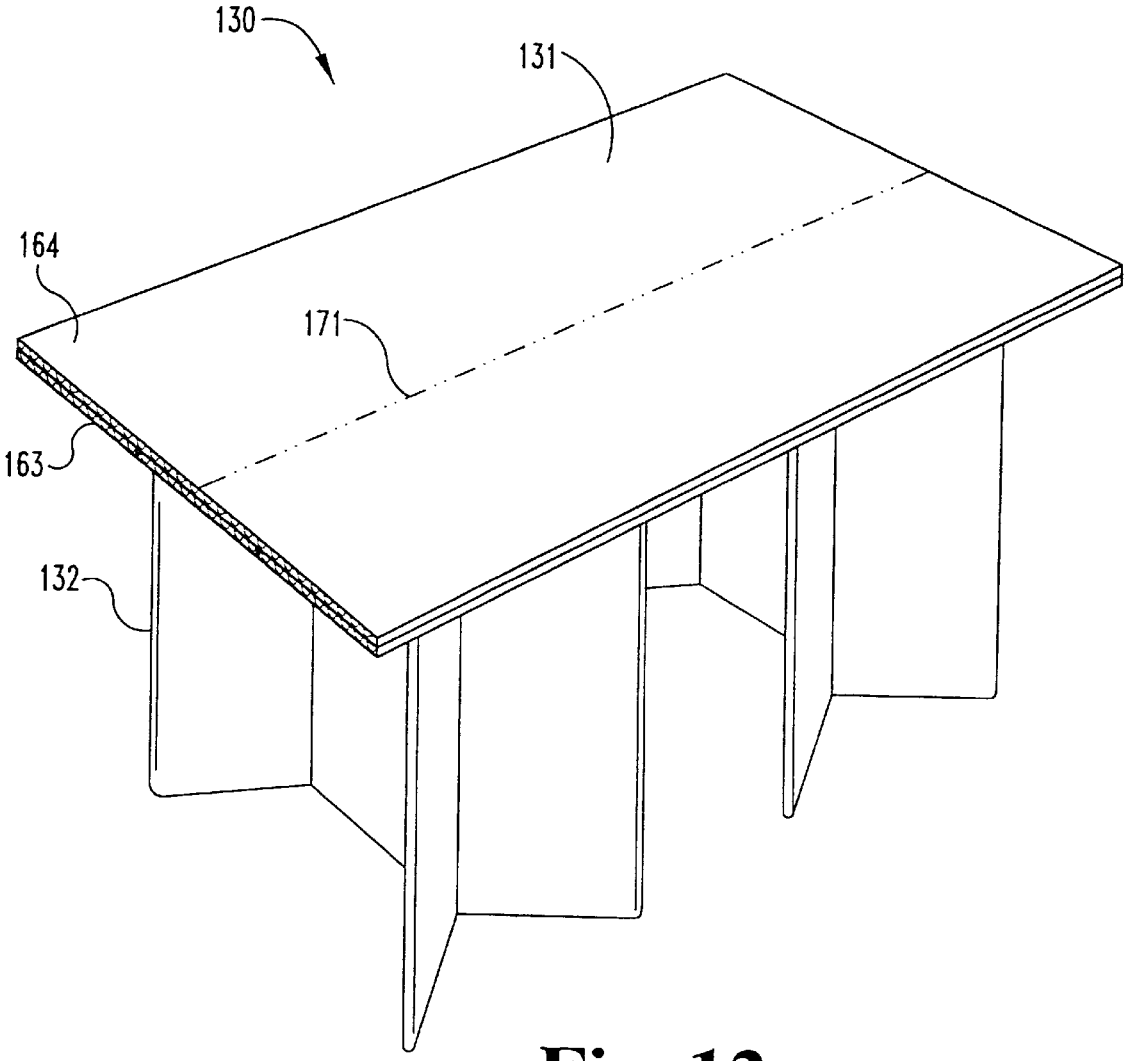
FIG. 12 is a perspective view of an article of knockdown or collapsible furniture in accordance with another embodiment of the present invention with the article here being a table 130.

Referring to FIGS. 12 and 15, cover member 164 comprises a single cardboard sheet that is creased at 171 right down the middle to enable it to be folded from a collapsed storage condition (FIG. 15) to an assembled flat condition (in FIG. 12).

In assembly, as with the seat 10 of FIGS. 1–11, base 132 is unfolded from its collapsed storage condition (FIG. 13) to its expanded support condition (FIG. 17). Table top support member 163 is folded along creases 157–162 to bring table beam sections 176 and 177 together and table beam sections 178 and 179 together, and whereby rectangular table sections 173, 174, and 175 are substantially mutually planar. With sheet 156 thus folded and turned upside down, as shown in FIG. 17, table beam sections 176–179 define the pair of parallel, longitudinal support beams 151 and 152. The pair of table bases 132 are lowered into position whereby beams 151 and 152 are received within the slots 150. The tabs 155 of base 132 are bent accordingly and seated within oval slots 169 of table support 163.

Since table support 163 and cover member 164 are not fixed together before assembly, no adhesive is automatically provided within oval slots 169, as is the case with slots 110 of FIG. 9. In this embodiment, adhesive may be provided on the appropriate sides of tabs 155 with an easily removable protective film applied over the adhesive. In this configuration, the film may be removed and the adhesive will be on the proper side of tabs 155 for adhesion to cover member 164 as described below. Alternatively, adhesive may be provided in the proper place on cover member 164 to bond with the tabs 155. In one embodiment, referring to FIG. 18, strips of adhesive 182 are provided on opposing sides of the top of sheet 156 with removable protective films 183 applied thereover. Upon assembly, protective films 183 are removed, and cover member 164 is unfolded and pressed onto the top of the assembled table support 163, the adhesive strips 182 bonding with cover member 164 to secure cover member 164 to table support 163. Alternatively, adhesive material may be applied to the cover member 164 instead of to table support 163, and additional adhesive material may be positioned on cover member 164 to align with oval slots 169 so that tabs 155, upon being seated within slots 169, may engage such additional adhesive on cover member 164 and be secured thereto.

While table 130 has been described using the tab 108/109 and slot 110 configuration for joining table top 131 to bases 132, it is contemplated that the slotted tab (85–88) and hooked slot (65–68) configuration of seat 10 may be used to connect table top 131 to bases 132, as well. This configuration would facilitate reuse of the table. That is, once the table with the adhesive method of construction is assembled, disassembly would likely damage or destroy the effectiveness of the adhesive strips. In the alternative, the slotted tab and hooked slot configuration lends itself well to reuse. Likewise, other methods of connection of the table top to its bases, as contemplated herein, such as Velcro®, would also permit reuse. It is also contemplated that table 130 may be made larger or in a different shape than that disclosed herein wherein, for example, more than two bases 132 are used to support table top 131, or table top support 163 has more or less support beams 150/151.

While the invention has been described in detail in the foregoing description, the same is to be considered as illustrative and not restrictive in character, it being understood that only the preferred embodiments have been shown and described, and that all changes and modifications that come within the spirit of the invention are desired to be protected.

What is claimed is:

1. An article of collapsible furniture, comprising:

a top member;

a one piece base, separate from said top member and having multiple panels, each of said panels being hingedly connected to at least one other of said panels and wherein said base has a collapsed storage condition wherein said panels are folded atop one another and said base has an expanded load supporting condition wherein said panels are unfolded to form, in horizontal cross-section, a central load-supporting polygon the polygon having at least four eight sides and being a simple concave polygon;

connection means for releasably locking said top member in a load supporting position atop said base; and, wherein the expanded load supporting condition includes said panels being unfolded to form, in horizontal cross-section, a central load-supporting polygon with vertices and with a support leg extending outwardly from at least four of the vertices.

2. The article of collapsible furniture of claim 1 further including an assembled condition wherein said top member and said base are connected together by said connection means and form a seat.

3. The article of collapsible furniture of claim 2 wherein said connection means includes each of the legs having a top edge and defining a slot opening upwardly from the top edge, and further including a plurality of locking tabs extending downwardly from said top member, at least one of the locking tabs being sized and configured to be releasably lockingly received within a corresponding one of the slots to hold said top member releasably connected with said base.

4. The article of collapsible furniture of claim 3 wherein each of the legs includes a hook that extends laterally into a corresponding slot, and wherein each locking tab defines an opening that is sized and positioned to releasably lockingly engage with the hook of a slot when the locking tab is positioned within the corresponding slot.

5. The article of collapsible furniture of claim 4 further including biasing means for urging said base to hold each locking tab within its corresponding slot.

6. The article of collapsible furniture of claim 4 wherein said top member and said base are made of corrugated cardboard.

7. The article of collapsible furniture of claim 4 wherein said base is made of a single sheet of material, folded and creased to define said multiple panels, and wherein at least one of said multiple panels is glued back-to-back to another of said multiple panels.

8. An article of collapsible furniture, comprising:

a seat member;

a base formed from a single sheet of material folded and creased along substantially parallel lines to define a plurality of rectangular panels, the panel at one end of said sheet being secured to the panel at the opposite end of said sheet, wherein said sheet has a thickness and said panels each have a width and said sheet is separate from said seat member;

a connection assembly including at least one tab extending from one of said seat member and said base and engagable with the other of said seat member and said base to releasable locking connect said seat member in a load supporting position atop said base;

wherein said base member has a collapsed storage position wherein said panels are folded atop one another and wherein said base has a maximum width and a maximum thickness and, in the collapsed storage position the maximum width of said base is approximately equal to or less than twice the average width of said panels and, in the collapsed storage positions the maximum thickness of said base is approximately equal to or less than four times the thickness of said sheet;

wherein said base has an expanded load supporting condition wherein said panels are unfolded to form, in horizontal cross-section, a central load-supporting polygon, the polygon having at least four sides; and, wherein said base in said expanded load supporting condition includes a plurality of substantially radially extending legs, each leg comprising two of said plurality of panels.

9. The article of collapsible furniture of claim 8 wherein said panel at one end is secured back-to-back to said panel at the opposite end.

10. The article of collapsible furniture of claim 9 wherein said panel at one end is glued back-to-back to said panel at the opposite end.

11. The article of collapsible furniture of claim 8 wherein said polygon is an octagon.

12. The article of collapsible furniture of claim 8 wherein said seat member and said base are made of cardboard.

13. The article of collapsible furniture of claim 8 wherein said connection assembly includes a plurality of tabs extendable downwardly from said seat member and a plurality of seat connection slots defined in said base, each of said slots being sized and configured to releasably lockably receive a corresponding one of said tabs.

14. The article of collapsible furniture of claim 13 wherein said base in said expanded load supporting condition includes a plurality of substantially radially extending legs, each of said legs defining one of said slots.

15. The article of collapsible furniture of claim 14 wherein said base includes a top edge and each of said slots opens upwardly from said top edge.

16. The article of collapsible furniture of claim 15 wherein said connection means further includes said base including at least one hook extending into at least one of said seat connection slots and includes at least one of said tabs defining a hook receiving slot that is sized and configured to releasably lockably receive a corresponding one of said hooks.

17. The article of collapsible furniture of claim 13 wherein said seat member and said base are made of cardboard.

18. An article of collapsible furniture, comprising:

a top member;

a base having multiple panels, each of said panels being hingedly connected to at least one other of said panels, and wherein said base has a collapsed storage condition wherein said panels are folded atop one another, and said base has an expanded load supporting condition including said panels being unfolded to form, in horizontal cross-section, a central load-supporting polygon with vertices and at least four sides and with a support leg extending outwardly from at least one of the vertices; and, connection means for releasably locking said top member in a load supporting position atop said base.

19. The article of collapsible furniture of claim 18 wherein there are at least four vertices and there are four support legs extending outwardly from the at least four vertices.

20. An article of collapsible furniture, comprising:

a top member;

a base having multiple panels each of said panels being hingedly connected to at least one other of said panels and wherein said base has a collapsed storage condition wherein said panels, are folded atop one another, and said base has an expanded load supporting condition wherein said panels are unfolded to form in horizontal cross-section, a central load-supporting polygon, the polygon having at least four sides, connection means for releasably locking said top member in a load supporting position atop said base, said connection means including said panels defining top edges and defining a plurality of slots opening upwardly from the top edges, and further including a plurality of locking tabs extending downwardly form said top member, at least one of the locking tabs being sized and configured to be releasably lockingly receiving within a corresponding one of the slots to hold said top member releasably connected with said base; and, wherein the expanded load supporting condition includes said panels being unfolded to form, in horizontal cross-section, a central load-supporting polygon with vertices and with a support leg extending outwardly from at least one of the vertices, the support leg having a top edge.

21. The article of collapsible furniture of claim 20 wherein there are at least four vertices and there is a support leg extending outwardly from each of the at least four vertices, and the slots are located in the top edges of the support legs.

22. An article of collapsible furniture, comprising:

a seat member;

a base formed from a single sheet of material, folded and creased along substantially parallel lines to define a plurality of rectangular panels, the sheet having opposing ends, the panel at one end of said sheet being secured to the panel at the opposite end of said sheet, wherein said sheet has a thickness and said panels each have a width and said sheet is separate from said seat member;

a connection assembly including at least one tab extending from one of said seat member and said base and engagable with the other of said seat member and said base to releasably locking connect said seat member in a load supporting position atop said base;

wherein said base has a collapsed storage position wherein said panels are folded atop one another and wherein said base has a maximum width and a maximum thickness and, in the collapsed storage position, the maximum width of said base is approximately equal to or less than twice the average width of said panels and, in the collapsed storage position, the maximum thickness of said base is approximately equal to or less than four times the thickness of said sheet;

wherein said base has an expanded load supporting condition wherein said panels are unfolded to form, in horizontal cross-section, a central load-supporting polygon, the polygon being an octagon; and, wherein said base in said expanded load supporting condition includes a plurality of substantially radially extending legs.

23. An article of collapsible furniture, comprising:

a seat member;

a base formed from a single sheet of material, folded and creased along substantially parallel lines to define a plurality of rectangular panels, the sheet having opposing ends, the panel at one end of said sheet being secured to the panel at the opposite end of said sheet, wherein said sheet has a thickness and said panels each have a width and said sheet is separate from said seat member;

a connection assembly including at least one tab extending from one of said seat member and said base and engagable with the other of said seat member and said base to releasably locking connect said seat member in a load supporting position atop said base;

wherein said base has a collapsed storage position wherein said panels are folded atop one another and wherein said base has a maximum width and a maximum thickness and, in the collapsed storage position, the maximum width of said base is approximately equal to or less than twice the average width of said panels and, in the collapsed storage position, the maximum thickness of said base is approximately equal to or less than four times the thickness of said sheet; and, wherein said base has an expanded load supporting condition wherein said panels are unfolded to form, in horizontal cross-section, a central load-supporting polygon, the polygon being an octagon, and wherein said base in said expanded load supporting condition includes a plurality of substantially radially extending legs, each leg comprising two of said plurality of panels.

* * * * *